US005694872A

United States Patent [19]

Zeller

[11] Patent Number: 5,694,872

[45] Date of Patent: Dec. 9, 1997

[54] CONTACT PRESSER APPARATUS FOR A MULTI-NEEDLE STITCHING MACHINE

[75] Inventor: Hans Zeller, Rebstein, Switzerland

[73] Assignee: Gateway (Textiles) Limited, Essex, United Kingdom

[21] Appl. No.: 565,828

[22] Filed: Dec. 1, 1995

[30] Foreign Application Priority Data

Dec. 14, 1994 [CH] Switzerland ..... 03785/94-2

[51] Int. Cl.[6] ..... D05B 29/00; D05B 1/08; D05B 11/00

[52] U.S. Cl. ..... 112/235; 112/117; 112/163

[58] Field of Search ..... 112/235, 236, 112/237, 163, 117, 165

[56] References Cited

U.S. PATENT DOCUMENTS

| | | | |
|---|---|---|---|
| 1,623,075 | 4/1927 | Thomas | 112/117 X |
| 2,491,685 | 12/1949 | Munz | 112/237 |
| 3,006,299 | 10/1961 | Enos | 112/235 |
| 3,282,237 | 11/1966 | Niekrawietz | 112/236 |
| 3,511,199 | 5/1970 | Howell | 112/235 |
| 3,633,525 | 1/1972 | Landoni | 112/117 |
| 4,006,696 | 2/1977 | Robertson | 112/117 |
| 4,438,712 | 3/1984 | Ducellier | 112/236 X |
| 4,716,846 | 1/1988 | Schneider et al. | 112/236 X |
| 4,981,094 | 1/1991 | Stapel et al. | 112/235 |
| 4,996,932 | 3/1991 | Nishimaki | 112/163 X |

FOREIGN PATENT DOCUMENTS

| | | |
|---|---|---|
| 2247050 | 4/1974 | Germany . |
| 3117140 | 11/1982 | Germany . |
| 8652241 | 1/1986 | Japan . |
| 189437 | 5/1924 | United Kingdom . |

*Primary Examiner*—Paul C. Lewis
*Attorney, Agent, or Firm*—Edwin D. Schindler

[57] ABSTRACT

A multi-needle stitching machine having a presser foot associated with each needle is provided. The presser foot is displaceably supported on a vertically disposed guide bar and downwardly displaceable by the force of a spring. The presser foot is liftable by the needle bar from the stitching material and lowerable onto the latter with an adjustable force during pricking. The presser head of the presser foot leads the needle when pricking the stitching material until the stitching material is firmly clamped on the sewing material table, and remains there until the needle has again exited from the stitching material.

9 Claims, 4 Drawing Sheets

CONTACT PRESSER APPARATUS FOR A MULTI-NEEDLE STITCHING MACHINE

BACKGROUND OF INVENTION

1. Technical Field of the Invention

The present invention relates to a contact presser apparatus for a multi-needle stitching machine.

More particularly, the present invention relates to a presser foot apparatus for a multi-needle stitching machine with a needle bar supporting a plurality of needles and effecting a vertical movement of the needles, and with a guide bar for vertically guiding the presser foot and means for pressing the presser foot against the surface of the stitching material. A precompression plate is provided through which the presser foot is passable.

2. Description of the Prior Art

Multi-needle stitching machines are used for quilting mattress overlays, and the like, and have a great number of needles arranged adjacent one another in any desired configuration. Such needles are synchronously introduced into the stitching material by a common drive and guide out from such material after the lower thread has been received and pulled into the material being stitched.

Modern multi-needle stitching machines are capable of producing 1,200 stitches per minute. So that the stitching material is not lifted by the needles when the latter exit again from the material after the latter has been pricked, it is known to the prior art how to mount precompression plates in front of the needle bars; the latter pressing the stitching material onto the stitching material table. The contact pressure of such plates must be sufficiently high to prevent the material from being lifted, or to allow the latter to be lifted only slightly, while the lengthwise and crosswise transport of the stitching material underneath the precompression plates is assured at the same time.

Furthermore, it is known to the art to lift the precompression plates from the stitching material after the needles have exited from the latter, by using a separate drive specifically intended for such purpose. The precompression plates extending across the entire width of the stitching machines are, on the one hand, disposed with a relatively great spacing from the needles, so that the stitching material can be slightly lifted in spite of the presence of the precompression plates; on the other hand, the means for lifting the precompression plates, in phase with the lifts of the needles, require a costly mechanism which, moreover, has to be a very stable structure for generating such contact pressure on stitching machines not capable of adapting to differences in the thickness of the stitching material.

SUMMARY OF THE INVENTION

It is, therefore, an object of the present invention to create a contact pressure-generating apparatus which, within the immediate range of the site of pricking of the needle, presses the stitching material against the stitching material table, keeps the stitching material pressed against the latter as the needle exits from the material, and cancels the contact pressure after the needle has exited from the stitching material.

The foregoing and related objects are achieved by the present invention, which provides a presser foot for a multi-needle stitching machine, which includes a needle bar supporting a plurality of needles and effecting a vertical movement of the needles, with a guide bar for vertically guiding the presser foot. Spring means are included for pressing the presser foot against a surface of a stitching material. A precompression plate is provided with an opening through which the presser foot is passable; said presser foot being pressable in a direction of a sewing material table by said spring means acting from above for pressing the stitching material within the range of the prick of a needle, and liftable from the needle bar supporting said needle, as illustrated in the drawing figures and as further recited in the appended claims.

With the contact pressure-generating apparatus according to the present invention, it is possible to firmly clamp the stitching material on the stitching material table, always shortly before the needle pricks the material, and retain it just until the needle has completely exited from the stitching material. In this way, the bottom thread can be completely drawn into the stitching material by the top thread. Additionally, the stitching material is released from the longitudinal or cross-transport immediately upon completion of each stitch. The presser foot, which surrounds the needle wholly or partly, protects the point of the needle during the transport of the stitching material even if the stitching material comes into contact with the sole of the presser foot due to its swelling filling. The presser foot leads the needle during lowering until the desired force of pressure has been built up on the stitching material, and the needle starts only then to prick the stitching material. The depth of penetration of the presser foot into the stitching material can be exactly adjusted and changed; furthermore, it adapts itself to the thickness of the filling in the site of pricking.

Other objects and features of the present invention will become apparent when considered in combination with the accompanying drawing figures which illustrate certain preferred embodiments of the present invention. It should, however, be noted that the accompanying drawing figures are intended to illustrate only certain embodiments of the claimed invention and are not intended as a means for defining the limits and scope of the invention.

BRIEF DESCRIPTION OF THE DRAWING FIGURES

In the drawing, wherein similar reference numerals denote similar features throughout the several views.

DETAILED DESCRIPTION OF THE DRAWING FIGURES AND PREFERRED EMBODIMENTS

Figure 1:
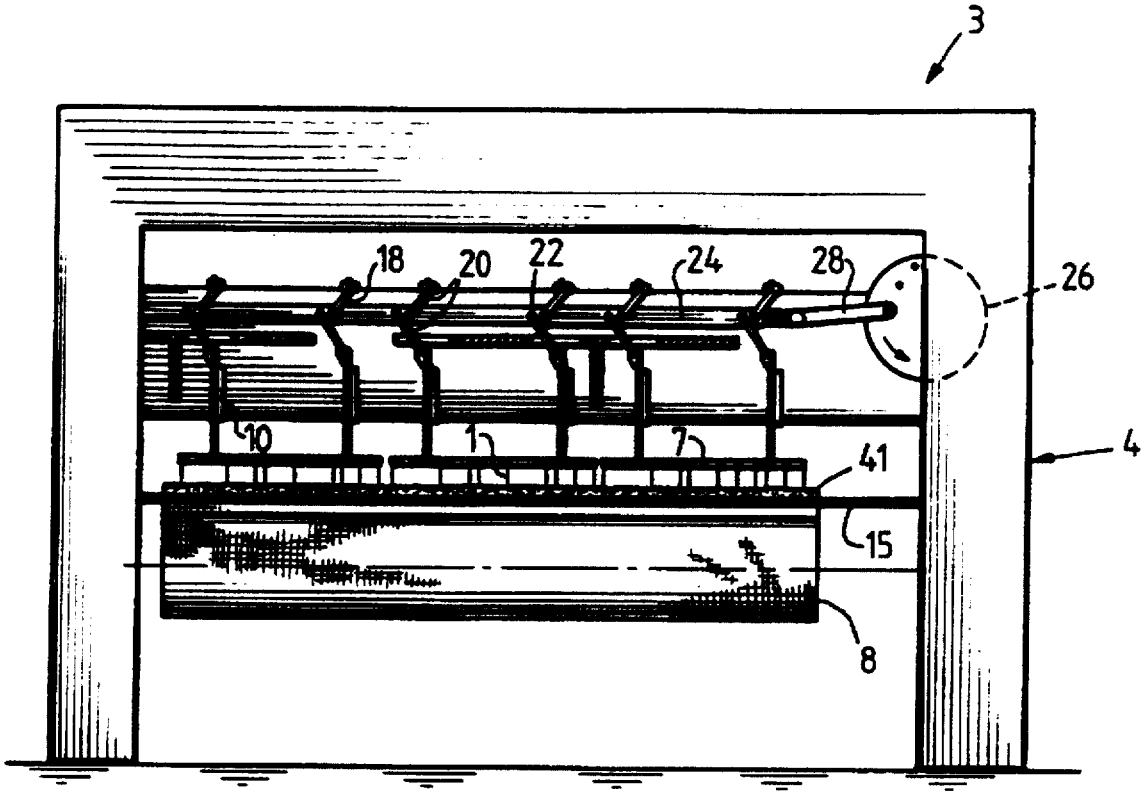
FIG. 1 shows a schematic, front view of the multi-needle stitching machine of the present invention.

Turning now, in detail, to an analysis of the drawing figures, in FIG. 1, reference numeral 3 denotes a multi-needle stitching machine with a frame 4, a sewing material table 15 for the sewing material 41, which is pulled off a sewing material supply roll 8 in front of the stitching machine 3 and across the sewing material table 15. The needle bar 7, with needles 1, is arranged above the sewing material table 15 and displaceably supported on the vertical guides 10. The needle bar 7 is connected with the frame 4 by the elbow joint lever pairs 18, which cooperate in pairs. The elbow joint lever pairs 18 comprise two elbow joint levers 20, the elbow joints 22, of which are connected with each other by a push rod 24. In connection with a multi-needle stitching machine 3 of a large width, one single needle bar 7 is replaced by a plurality of needle bars 7, preferably having the same length; such needle bars each being suspended on the frame 4 with one or a plurality of elbow joint lever pairs 18. The push rod 24 may extend across the entire width of the machine 3, or it may be comprised of several part segments conforming to the length of the individual needle bars 7.

In FIG. 1, a crank drive 26 is shown on the right side of the multi-needle stitching machine 3; said crank drive being connected with the push rod 24 by means of a crank rod 28. In FIG. 1, the needle bar 7 is disposed in approximately the highest possible position, i.e., the needles 1 are approximately at their uppermost point of reversal.

Figure 2:
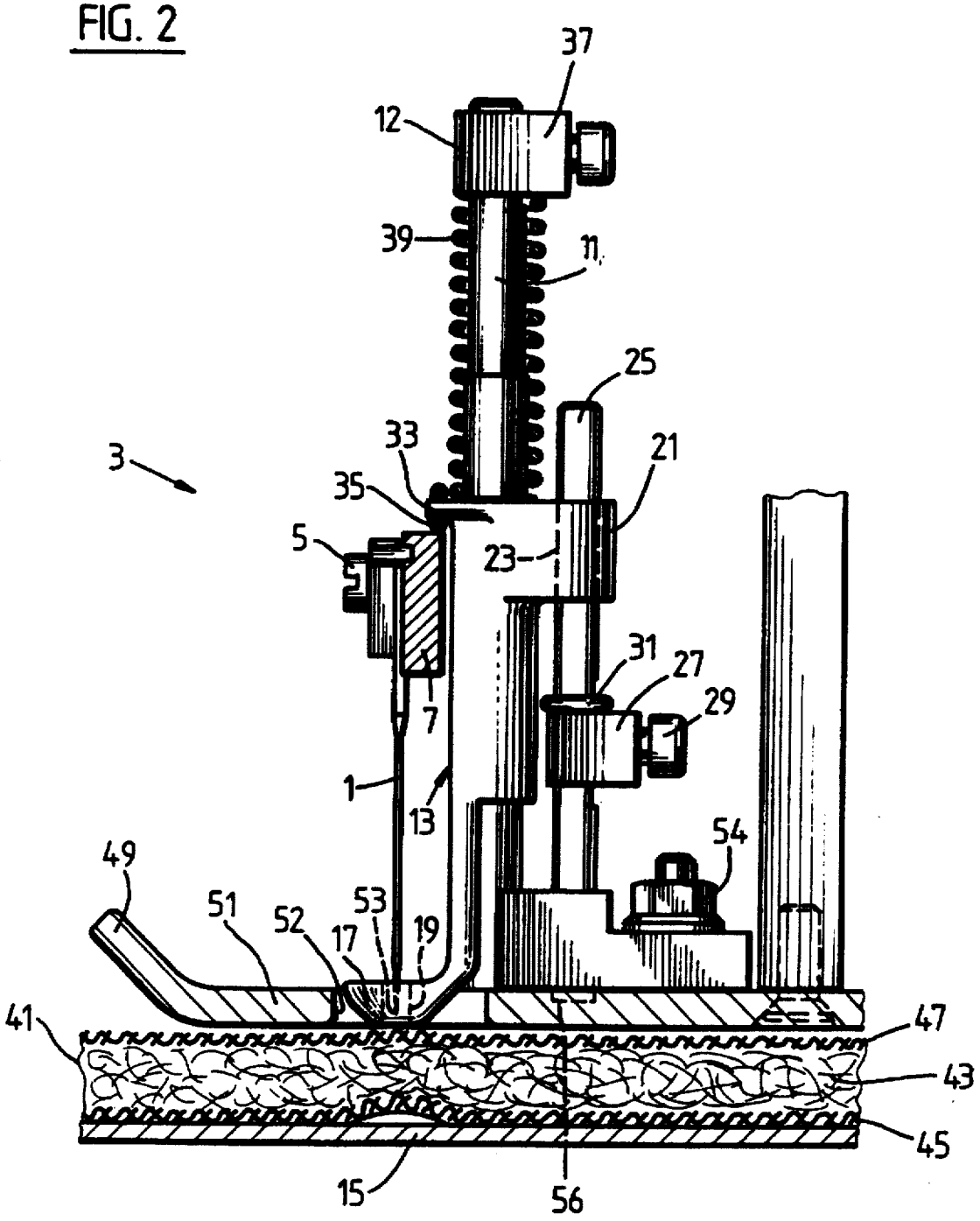
FIG. 2 shows a lateral view of a presser foot and of the needle cooperating with the latter (shown in a lifted position for transporting the stitching material)

In FIG. 2, needle 1 is fastened on the horizontal needle bar 7—also referred to as a needle arm—with a screw 5. Each needle bar 7 extends across a part range of the width of the multi-needle stitching machine 3, and supports a great number of the identical needles 1. The needle bar 7 is moved in the vertical direction by the amount of the lift of the needle by means of the drive 26, as indicated in FIG. 1. A preferred needle drive is disclosed in Applicant's co-pending U.S. patent application Ser. No. 08/565,827, filed Dec. 1, 1995, the subject matter of which is hereby incorporated by reference.

To the right of the needle bar 7, the guide bar 11 is mounted for each needle I as a vertical guide, and guides a presser foot 13 perpendicularly to the stitching material table 15; the latter being disposed horizontally. At its bottom end, the presser foot 13 has a presser head 17, preferably designed in the form of a cup, with a bore 19 in the center of said head for the passage of the needle 1. The presser head 17 is longitudinally guided substantially without play by the guide sleeve 21 surrounding the guide bar 11. In order to prevent the guide sleeve 21 or the presser foot 13 from turning, provision is made for a guide bore 23 in the guide sleeve 21; said guide bore being penetrated by an auxiliary guide bar 25. A stop 27 with a setscrew 29 may be mounted on the auxiliary guide bar 25, by which setscrew, the stop 27 can be fixed on the auxiliary guide bar 25. A damping element 31 is mounted on the top shoulder of the stop 27; in the preferred embodiment of the present invention being illustrated, this element is an O-ring.

At the top end of the guide sleeve 21, a stop nose 33 projects to the left to an extent so that its end comes to be disposed above the vertical range of travel of the needle bar 7. Furthermore, an elastic buffer element 35 is mounted on the nose 33, which element, when in contact with the needle bar 7, dampens the impact and reduces the noise.

An adjustable and changeable spring-retaining element 37 is mounted on the top end of the guide bar 11 and is displaceable on said bar; the pretension of a spiral spring 39 looping around the guide bar 11 is adjustable with said element. The spiral spring 39 rests against the top side of the guide sleeve 21, on the one hand, and against the underside of the spring-retaining element 37, on the other hand.

The stitching material 41 is present between the cup-shaped underside of the presser head 17 and the surface of the sewing or sewing material table 15. In the preferred embodiment of the invention illustrated, said material 41 comprises a wadding core 43, as well as a bottom fabric 45 anti a top fabric 47. A precompression plate 51 is arranged parallel with, and above, the sewing material table 15; the spacing of said plate from the surface of the sewing material table 15 is adjustable. On the inlet side, said plate has an edge 49, the latter being bent upwards. Within the zone of the presser feet 13, provision is made for the recesses 52 in the precompression plate 51; the presser heads 17 can be passed through said recesses with play. In the preferred embodiment of the invention shown, the precompression plate 51 supports both the guide bars 11 and the auxiliary guide bars 25, with the presser feet 13 slidably mounted thereon with the screws 54, whereby for the purpose of centering, the lower ends of the auxiliary guide bars 25 additionally engage a centering bore 56 in the surface of the precompression plate 51.

The arrangement as shown in FIG. 2 is present when the needle 1 is at its top point of reversal and the presser head 17 of the presser foot 13 assumes its highest possible position as well, in which it is lifted from the stitching material 41.

Figure 3:
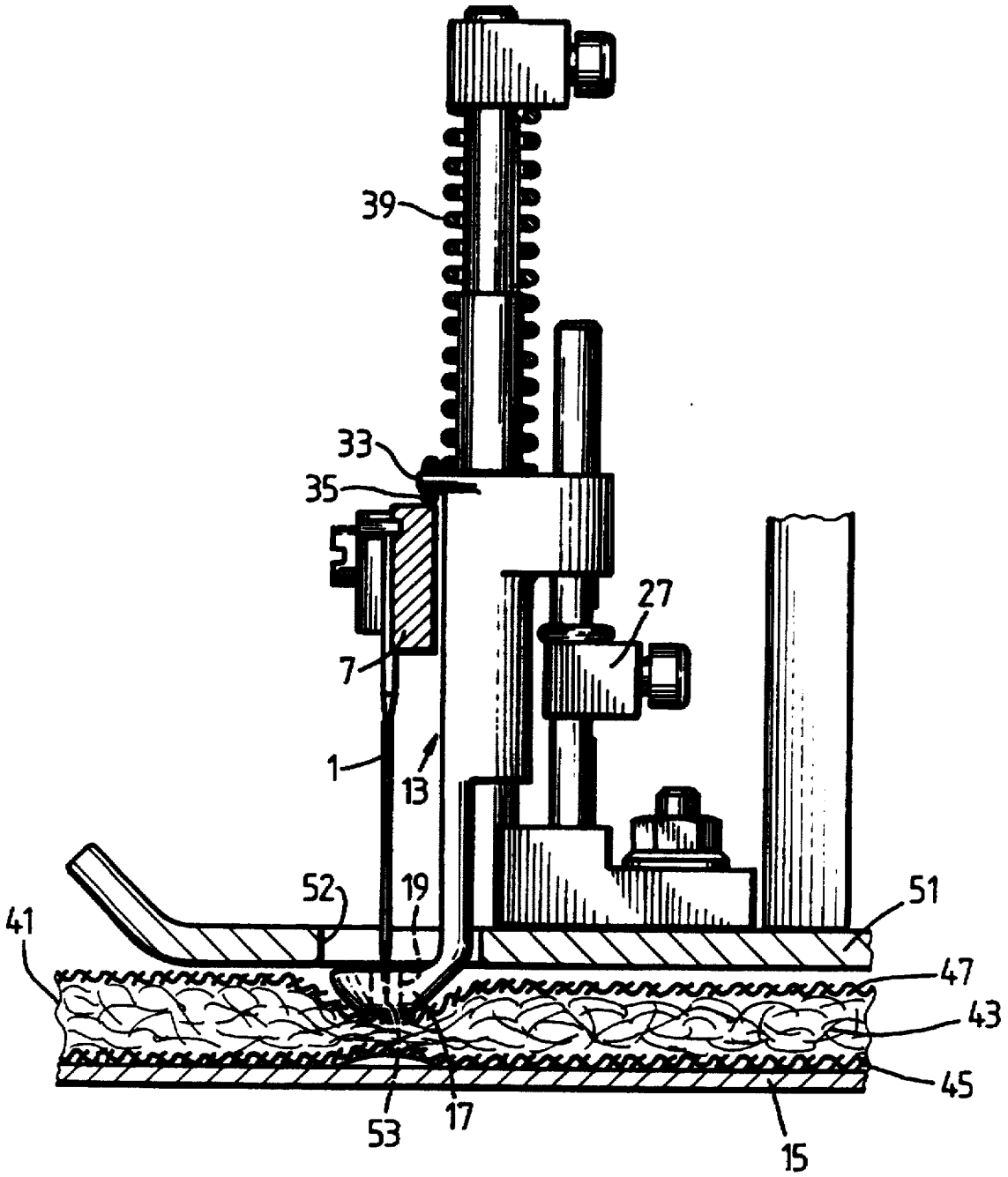
FIG. 3 shows a lateral view of a presser foot and of the needle cooperating with the latter (with the needle partly lowered and the presser foot completely lowered); and, FIG. 4 shows a lateral view of a presser foot and of the needle cooperating with the latter (with the needle inserted in the stitching material.)

In FIG. 3, the drive (not shown) leads the needle bar 7 with the needles 1 vertically downward. During such movement, at the beginning, the point 53 of the needle 1 is always disposed protected within the bore 19 in the presser head 17. During the lowering movement of the needle bar 7, the presser foot with the stop nose 33, resting on the needle bar 7 at the top, follows the downward movement due to the pre-tension of the spring 39. As soon as the cup-like underside of the presser head 17 starts to press against the top material 47, after the latter has passed through the recess 52 in the precompression plate 51, the movement of the presser foot 13 is resisted. Such resistance depends on the elasticity of the wadding core 43 and on the thickness of the latter. Said resistance, which increases successively, effects the compression of the wadding core 43, thereby causing the stop nose 33 to lift from the needle bar 7. The downward movement of the presser foot 13 can be limited by the stop 27 in order to adjust in this way—if deemed desirable—the thickness of the stitching material 41 within the range of the seam to be produced. Since each presser foot 13 is adjustable individually, it is possible in this manner to produce a topographically extending pattern along the needle bar 7.

Figure 4:
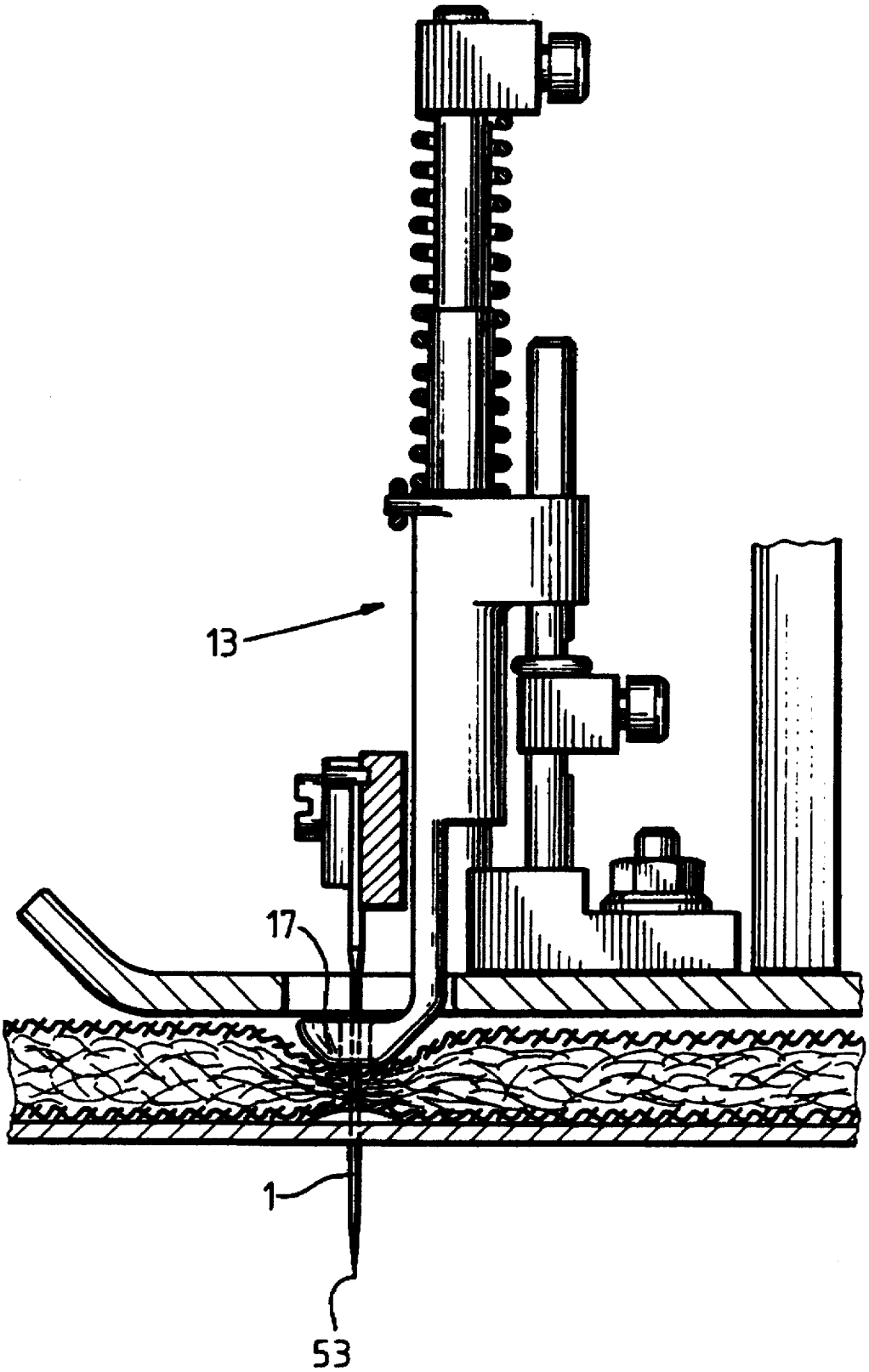

The needle 1 and the presser foot 13 now move relative to each other. While the needle 1 is pricking the stitching material 41, the latter is retained by the presser head 17. Said condition, which is shown in FIG. 4, is maintained until the needle bar 7, the latter driving upwardly again after the pricking process, strikes the stop nose 33 or the buffer element 35—the latter being mounted on the stop nose 33—from the bottom end and, in this way, lifts the presser foot 13 from the stitching material 41. The spring 39 is compressed during the lifting action. At the point in time at which the needle bar 7 starts to lift the presser foot 13, the needle point 53 is, again, already within the bore 21. However, before the presser foot 13 is lifted from the stitching material 41, the needle 1 pulls the top thread with the bottom thread (both threads not shown) received beneath the stitching material table 15 into the stitching material 41. Thereafter, lifting of the presser head 17 from the stitching material 41 takes place synchronously with the upward drive of the needle 1. The situation is again the same as shown in FIG. 2, permitting the start of another prick as well as the prior displacement of the sewing material 41.

While only several embodiments of the present invention have been shown and described, it will be obvious to those skilled in the art that many modifications may be made to the present invention without departing from the spirit and scope thereof.

LIST OF REFERENCE NUMERALS

| | |
|---|---|
| 1 | needle |
| 3 | multi-needle stitching machine |
| 4 | frame |
| 5 | screw |
| 7 | needle bar |
| 11 | guide bar |
| 13 | presser foot |
| 15 | sewing table |
| 17 | presser head |
| 19 | bore |
| 21 | guide sleeve |
| 23 | bore (auxiliary) |
| 25 | auxiliary guide bar |
| 27 | stop |
| 29 | adjusting screw |
| 31 | damping element |
| 33 | stop nose |
| 35 | buffer element |
| 37 | spring-retaining element |
| 39 | spiral spring |
| 41 | stitching material |
| 43 | wadding core |
| 45 | bottom material |
| 47 | top material |
| 49 | inlet rail |
| 51 | precompressing element |
| 53 | needle point |

What is claimed is:

1. A presser foot for a multi-needle stitching machine, comprising:

a needle bar supporting a plurality of needles and effecting a vertical movement of said plurality of needles;

a presser foot being in contact with, and liftable by, said needle bar;

lifting means for said needle bar for lifting said presser foot relative to said needle bar;

a guide bar for vertically guiding said presser foot;

spring means For pressing said presser foot against a surface of a stitching material;

a sewing material table; and, a precompression plate for pressing the stitching material having an opening through which said presser foot is passable, said presser foot being pressable in a direction of said sewing material table by said spring means acting from above for pressing the stitching material within the range of the prick of a needle of said plurality of needles, and said presser foot being liftable by said lifting means from said needle bar supporting said needle.

2. The presser foot for a multi-needle stitching machine according to claim 1, further comprising a guide sleeve and an auxiliary guide bar for vertically guiding said presser foot, said guide sleeve is displaceably supported on said guide bar, with said spring pressing onto said guide sleeve from above.

3. The presser foot for a multi-needle stitching machine according to claim 2, further comprising a stop nose being mounted on said guide sleeve, said stop nose resting on said needle bar and being pressed by said spring.

4. The presser foot for a multi-needle stitching machine according to claim 2, wherein said guide sleeve is additionally guided by said auxiliary guide bar and secured against rotation.

5. The presser foot for a multi-needle stitching machine according to claim 4, wherein said auxiliary guide bar is mounted on said precompression plate.

6. The presser foot for a multi-needle stitching machine according to claim 1, wherein said guide bar is mounted on said precompression plate.

7. The presser foot for a multi-needle stitching machine according to claim 1, further comprising a stop being arranged on said precompression plate, by which stop a distance of displacement of said presser foot is limitable downwardly and a spacing between said sewing material table and a sole of said presser foot being adjustable.

8. The presser foot for a multi-needle stitching machine according to claim 1, further comprising a tensioning element being displaceable on said guide bar with the biassing force of said spring being adjustable by said tensioning element.

9. The presser foot for a multi-needle stitching machine according to claim 1, wherein each said presser foot is associated with one of said needles of said plurality of needles, so that each said presser foot operates with a given needle and independently of other needles and presser feet.

* * * * *